United States Patent [19]

Cowley et al.

[11] 4,088,200

[45] May 9, 1978

[54] LIFTING APPARATUS

[75] Inventors: David Cowley, Wingerworth; Raymond Jeffrey Phillips, Matlock, both of England

[73] Assignee: John Laing and Son Limited, London, England

[21] Appl. No.: 741,287

[22] Filed: Nov. 11, 1976

[30] Foreign Application Priority Data

Nov. 18, 1975 United Kingdom ..... 47368/75
Sep. 26, 1976 United Kingdom ..... 39368/76

[51] Int. Cl.[2] ..... B66F 11/04
[52] U.S. Cl. ..... 182/2; 182/63
[58] Field of Search ..... 182/2, 62.5, 63, 141, 182/148; 212/144, 17; 214/86 R, 87, 130 R; 187/9 R, 9 E

[56] References Cited

U.S. PATENT DOCUMENTS

| | | | |
|---|---|---|---|
| 1,960,355 | 5/1934 | Tamini | 182/62.5 |
| 2,988,163 | 6/1961 | Foley | 182/2 |
| 3,072,215 | 1/1963 | Rush | 182/2 |
| 3,154,199 | 10/1964 | Balogh | 182/2 |
| 3,481,409 | 12/1969 | Westerlund | 182/2 |
| 3,927,732 | 12/1975 | Ooka | 182/62.5 |

*Primary Examiner*—Reinaldo P. Machado
*Attorney, Agent, or Firm*—Cesari and McKenna

[57] ABSTRACT

A lifting apparatus, which is particularly suitable for mounting on a truck, includes a vertically extendable telescopic arm having outriggers which can be extended to the ground to provide support and a cage, supported on a second arm which extends from the upper end of the telescopic arm, the second arm being rotatable about the axis of the telescopic arm and pivotable with respect to the arm in a plane containing the said axis.

6 Claims, 15 Drawing Figures

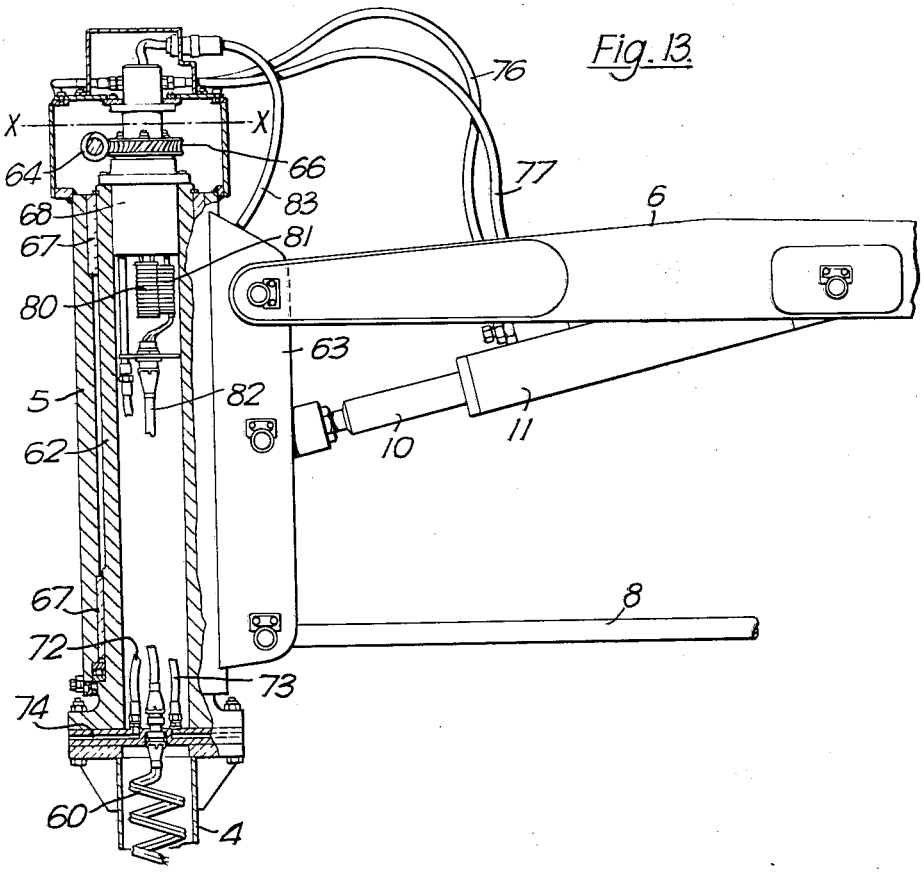
Fig. 13.
Fig. 14.
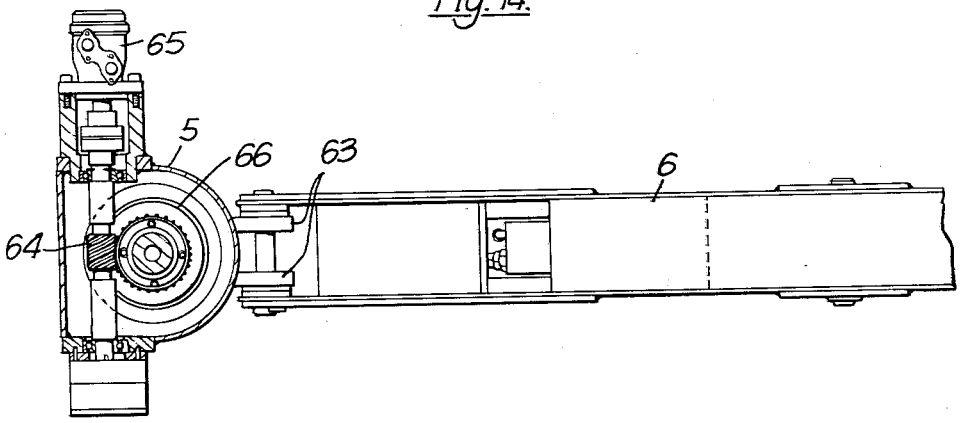

LIFTING APPARATUS

This invention relates to lifting apparatus and it will be described, by way of example, with reference to a particular embodiment which includes an arm carrying a platform, the said arm being capable of vertical and horizontal rotation about a telescopically extendable member.

Features of the embodiment to be described are that the telescopically extendable member is able to extend vertically during operation and that the arm is able to rotate through 360° in a horizontal direction and through almost 180° in a vertical direction about the member.

It is also a feature of the embodiment to be described that it can be mounted on a vehicle for transport and be brought into its operating condition while on the vehicle in a comparatively simple way.

The said embodiment of the invention will now be described with reference to the accompanying drawings in which:

FIG. 1 is a diagrammatic side view of a lifting apparatus mounted on a truck and in the operating position, FIG. 2 is a diagrammatic plan view of the apparatus of FIG. 1, FIG. 3 is a side view of the truck and apparatus shown in FIG. 1 with the apparatus in the position for transport, FIG. 4 is a diagrammatic part-sectional plan view of the apparatus of FIG. 1, FIG. 5 is a part-sectional end view of a part of the apparatus, FIG. 6 is a sectional view on the line 1—1 of FIG. 5, FIG. 7 is a partly sectioned side view of a part of a telescopic member, FIG. 8 is a plan view of a part of the member shown in FIG. 7, FIGS. 9, 10, 11 and 12 are sections on the lines A—A, B—B, C—C and D—D of FIG. 7, FIG. 13 is a partly sectioned side view of a part of the apparatus, FIG. 14 is a plan view partly sectioned on the line X—X of FIG. 13 of the arrangement shown in FIG. 13, and FIG. 15 is a diagrammatic block schematic drawing illustrating a part of the electrical control circuit of the apparatus.

Referring to the drawings, there is shown in FIG. 1 a side view of a truck 1 upon which there is mounted a lifting apparatus including an assembly constituted by telescopically extendable tubular members 2, 3 and 4, the inner section 4 carrying a rotatable outer casing 5 which supports an arm 6 carrying a cage 7 forming a working platform. The cage 7 is coupled to the rotatable casing 5 by means of a second arm 8 which completes a parallelogram in a well known manner to maintain the cage 7 vertical during use. The arm 6 is rotated vertically about the casing 5 by means of a piston 10 and cylinder 11 arrangement. The cage 7 is shown in its maximum upper position at 12 and in its maximum lower position during operation at 13. The extent of movement of the cage 7 is indicated by dotted line 14. The apparatus described is partly supported by the truck 1 and partly by outrigger legs, one of which is visible at 15 and which extend to the ground from the base of the telescopically extendable arrangement of sections 2, 3 and 4.

Figure 1:
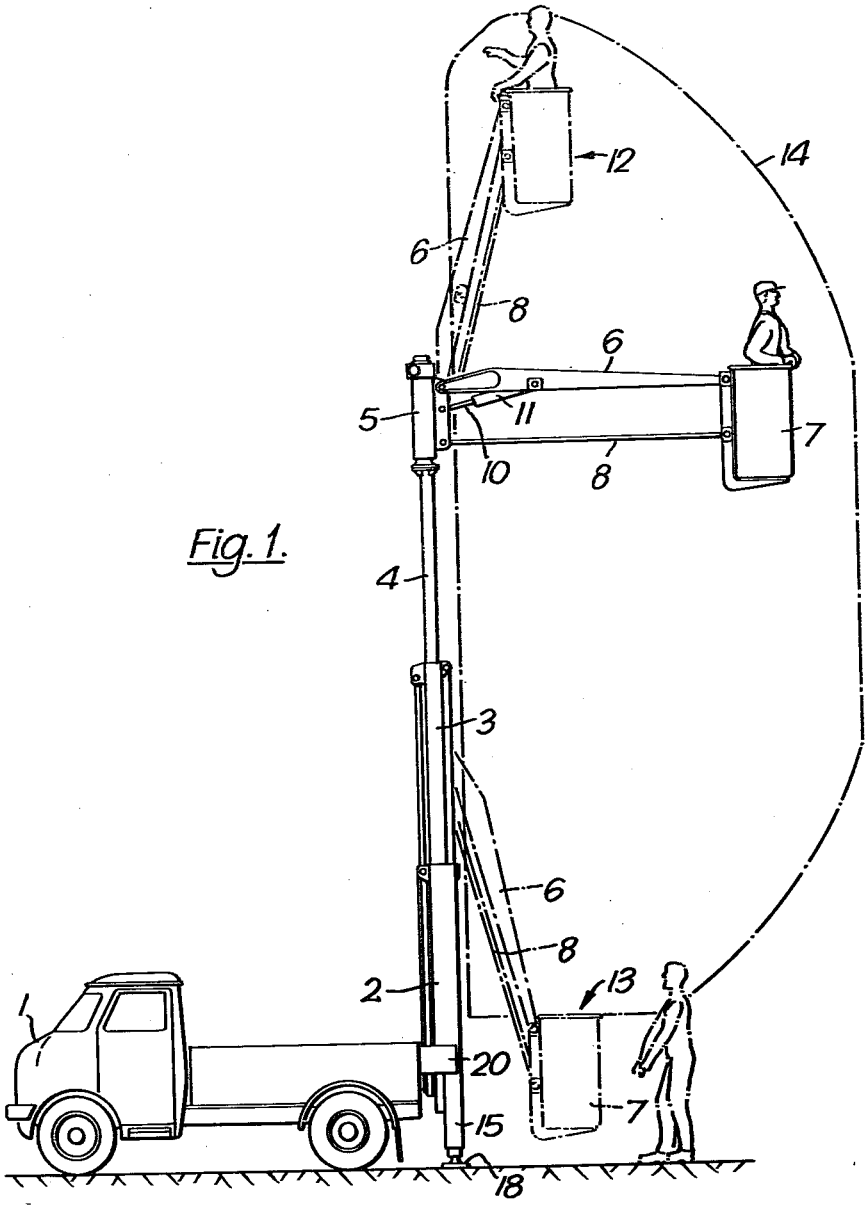
Figure 2:
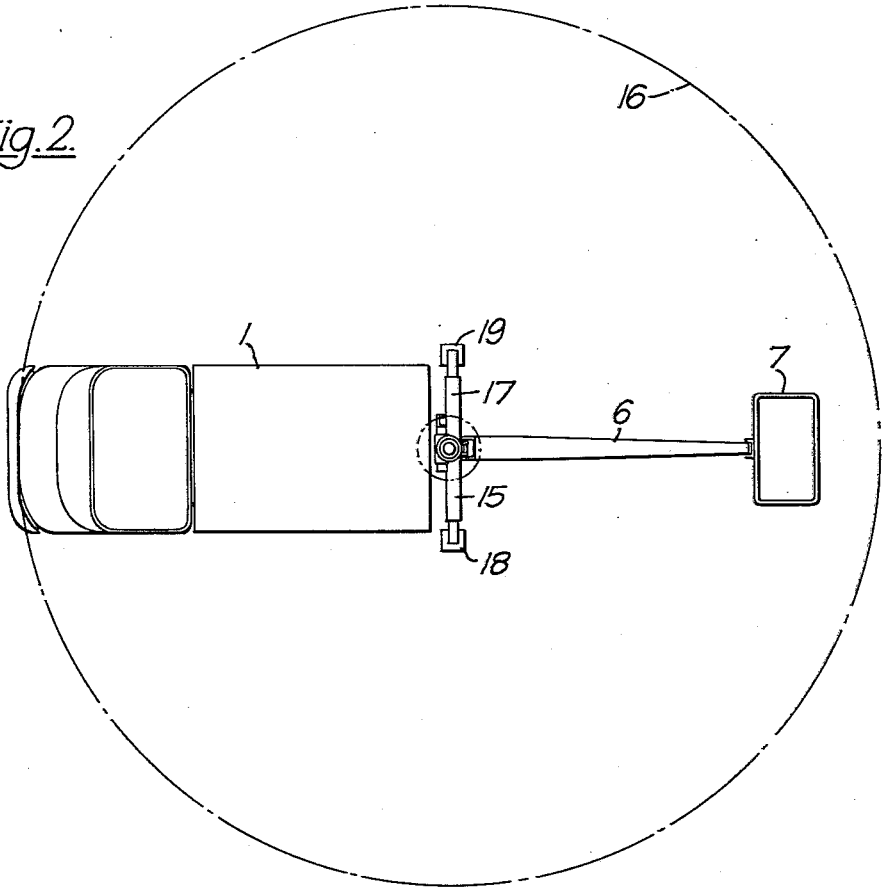
FIG. 2 illustrates, in a plan view, the clearance required at 16 to enable complete 360° rotation of the cage to be obtained. In the view shown in FIG. 2, the second outrigger leg 17 is clearly visible.
Figure 3:
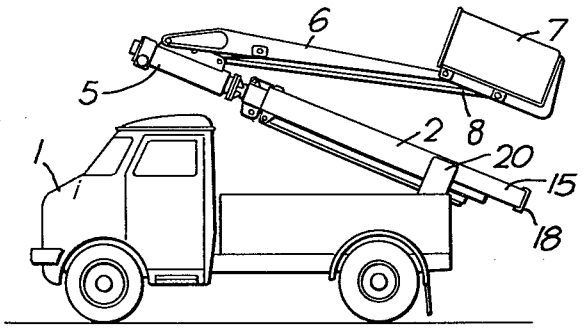
FIG. 3 illustrates the apparatus when retracted and folded down on to the truck for transport.
Figure 4:
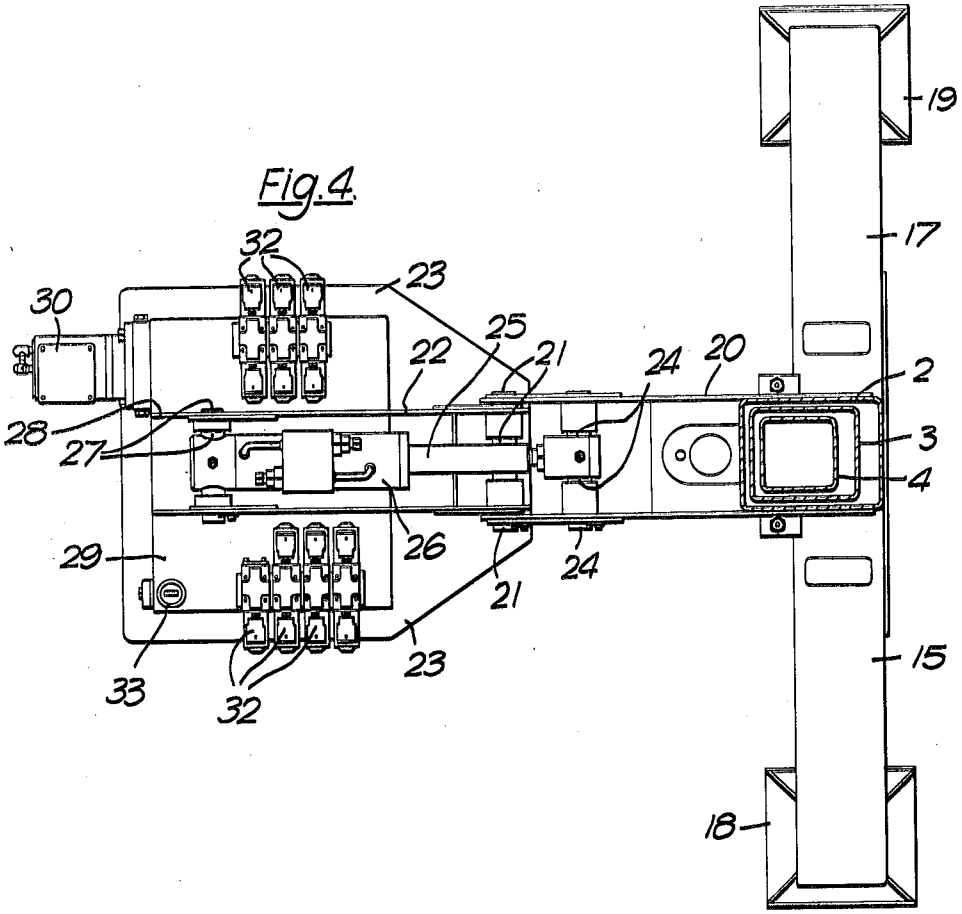

In FIG. 4, there is shown a section through the members 2, 3 and 4 of the telescopically extendable assembly. FIG. 4 also shows other parts of the apparatus, for example the outrigger legs 15 and 17 and feet 18 and 19 on the legs in plan view. The assembly of telescopically extendable members is attached by a bracket arrangement 20 near to its base via a pivot pin 21 to a bracket 22, attached to a base plate 23. Above the pivot pin 21 for the whole assembly there is a second pivot pin 24 to which a piston rod 25 is rotatably coupled. The piston rod 25 is attached to a piston in a cylinder 26 and is hydraulically operated. The cylinder 26 is pivoted about a pin 27 supported upon a bracket 28 on top of a tank 29 containing the hydraulic fluid used for operating the piston 25 and the cylinder 26 arrangement. An electrically driven motor indicated at 30 is used to pump the hydraulic fluid from the tank 29 throughout the system, the hydraulic fluid being used, not only to operate the piston 25 and cylinder 26 arrangement, but also the feet 18, 19, the assembly of telescopically extendable members 2, 3 and 4 and of the cage 7 and arm 6 to which it is attached. Valves indicated at 32 are used to control the flow of hydraulic fluid throughout the system and a filler cap for the hydraulic fluid tank 29 is indicated at 33. The whole lifting apparatus is thus mounted on the base plate 23 which can easily be removed from the truck 1 and mounted in some other way. When the apparatus is mounted on a truck, the truck forms part of the support for the apparatus and, if it were separated, some further support would have to be provided in addition to the outrigger legs 15 and 17. It will be noted that the movement of the piston rod 25 to erect the assembly of telescopically extendable members to the vertical position is comparatively short and thus minimizes the time required.

Figure 5:
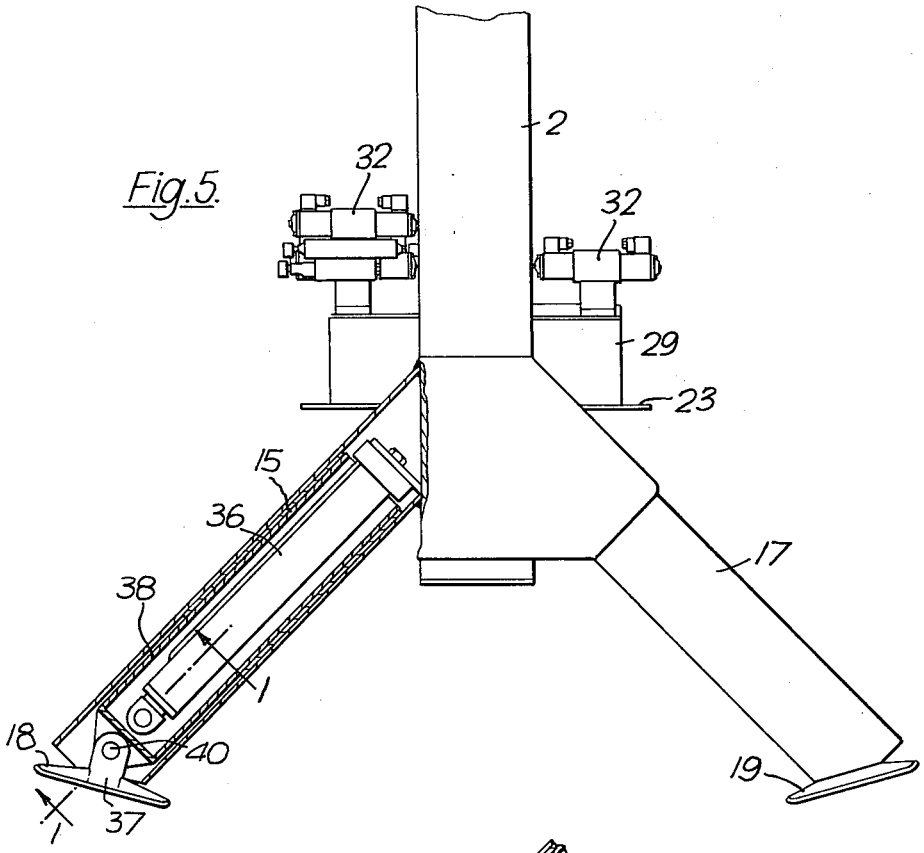

Referring to FIG. 5, there is shown a section through the outrigger leg 15 revealing a piston 35 and cylinder 36 arrangement which enables the foot 18 on a bracket 37 attached to an inner cylinder 38 to be extended by the piston 35, as required, to enable the assembly of telescopically extendable members to be positioned vertically, whatever the level of the supporting ground.

Figure 6:
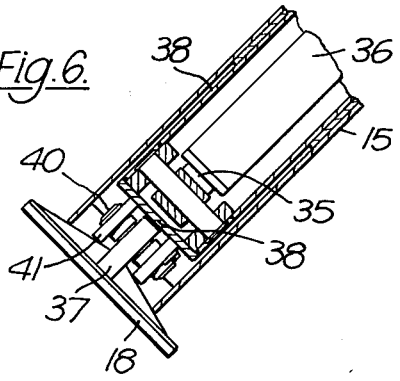

In FIG. 6, there is shown a pivot pin 40 supported by a bracket 41 attached to the lower end of the inner cylinder 38 and carrying the bracket 37 to which the foot 18 is pivotally attached, thereby enabling the foot 18 to tilt and rest easily and more firmly on sloping ground than would otherwise be the case. The operation of the piston 35 and cylinder 36 arrangement is controlled by particular ones of the valves 32 on top of the tank 29.

Figure 7:
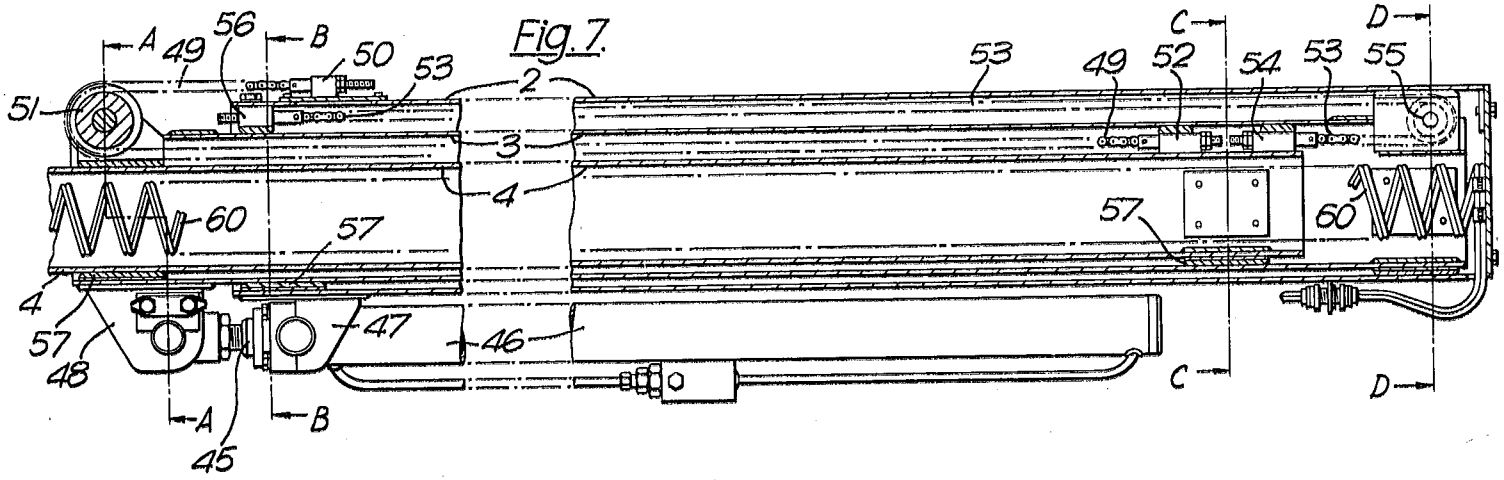
Figure 8:
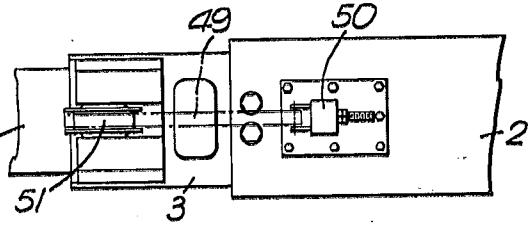
Figure 9:
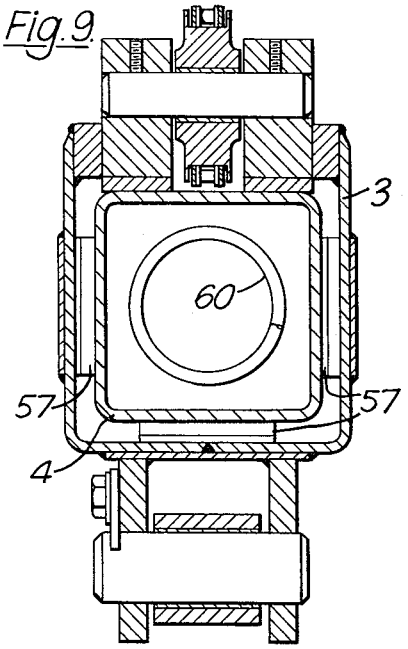
Figure 10:
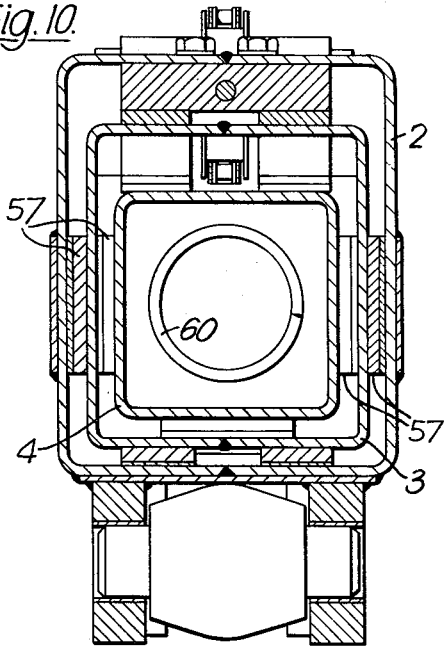
Figure 11:
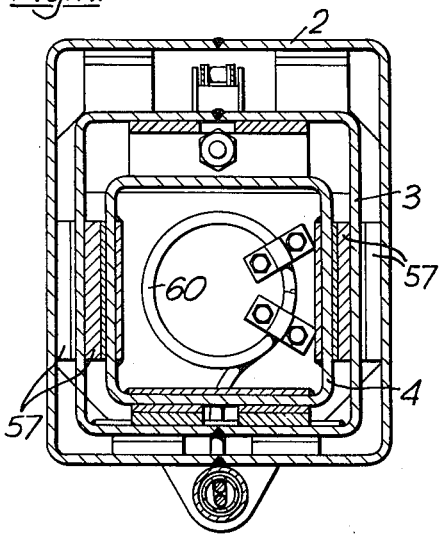
Figure 12:
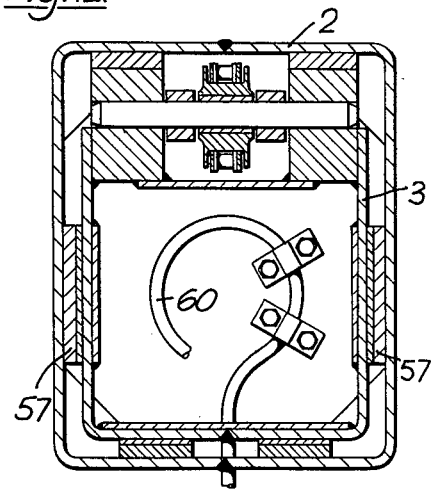

In FIG. 7, there is shown a piston 45 and cylinder 46 arrangement, also operated via particular ones of the valves 32, the cylinder 46 being attached to the outer member 2 of the telescopically extendable assembly by a bracket 47. The outer member 2 of the telescopically extendable assembly is attached to the bracket 20 and thus via the pivot pin 21 to the base plate 23 mounted on the truck and the piston 45 is pivotally attached via a bracket 48 to the intermediate tubular member 3 of the telescopically extendable assembly. A chain 49 extends from a mounting 50 on the outer one 2 of the telescopically extendable members via a pulley wheel 51 attached to the intermediate one 3 of the members to a mounting 52 on the inner one 4 of the members. A second chain 53, attached to a mounting 54 on the inner one 4 of the telescopically extendable members, extends via a second pulley 55, also attached to the intermediate member 3 to a mounting 56 attached to the outer member 2. The chains 49 and 53 used in the particular embodiment are triplex chains, i.e., they have three rows of links side by side, and they may each be duplicated on the opposite side of the assembly in order to provide additional safety. Spacer pads 57 made of a material which enables the tubular members 3 and 4 to slide thereon are provided to maintain the spacing between the members.

In operation, when the piston 45 is caused to extend from the cylinder 46, the intermediate tubular member 3 is caused to extend from the outer tubular member 2 as a result of the force exerted via the bracket 48 and at the same time the inner tubular member 4 is caused to move out of the intermediate tubular member by the same amount, as a result of the action of the chains 49 and 53 coupling the members 2, 3 and 4 together. It will be seen that chain 49 is pulled by the action of pulley wheel 51 as the intermediate member 3 extends from member 2 and thereby causes the inner member 4 to be pulled by the chain 49 and mounting 52 and moved out of the intermediate member 3 at the same time. The chain 53 acts in a similar way in retracting the assembly. An electrical cable 60 is shown, in an extendable coil form, passing through the centre of the inner member 4 of the telescopically extendable assembly in order to enable electrical signals to be conveyed from a control panel on the cage to the hydraulic valves 32 which are electrically controlled.

Referring to FIGS. 13 and 14, there is shown the upper end of the inner member 4 of the telescopically extendable assembly to which there is bolted an inner tubular member 62. Rotatable about the inner tubular member 62 is the casing 5 to which there is attached a bracket 63 supporting the arm 6 and piston 10 and cylinder 11 arrangement. To the rotatable casing 5, there is attached a worm 64 driven by a motor 65. The worm 64 co-operates with a relatively fixed pinion wheel 66 which is attached to the inner tubular member 62. Rotation of the worm 64 causes the outer casing 5, to which it is attached, to rotate around the inner tubular member 62 from which it is spaced by means of bearing elements 67. It is possible, as a result of this arrangement, to provide a complete 360° rotation continuously of the casing 5 and assembly of cage 7, arm 6, piston 10 and cylinder 11 arrangement and arm 8 about the member 4. Hydraulic fluid for the operation of the piston 10 and cylinder 11 arrangement is coupled via a distributor 68 having a fixed outer portion and a rotatable inner portion and conveying fluid via pipes 72 and 73 and channels 74 and 75 from externally running pipes (not shown) to tubes 76 and 77. The coupling of electrical signals is provided via a rotatable slip ring 80 and brush assembly 81 and a cable 82 which is coupled to the cable 60 which passes through the centre of the telescopically extendable assembly to a cable 83 which runs to a control panel (not shown) on the cage 7.

A duplicate control panel (not shown) is also provided on the truck 1 so that the electrically operated hydraulic valves 32 can be controlled either from the cage 7 or from the truck 1.

In operation, electrical signals from either of the control panels operate respective ones of the valves 32 to actuate one or more of the piston and cylinder arrangements 10, 11; 25, 26; 35, 36; 45, 46, as required.

Figure 15:
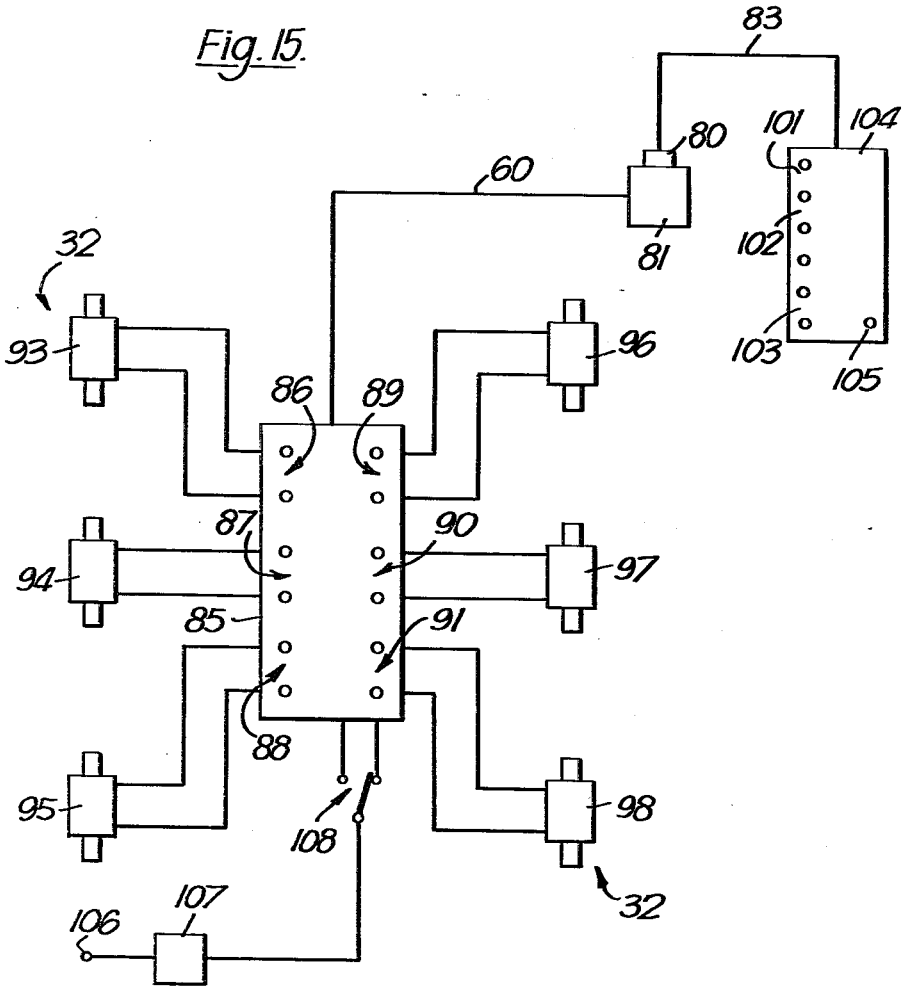

In FIG. 15, there is shown a diagrammatic representation of a part of the electrical circuit including duplicate control panel 85 mounted on the truck 1. The control panel 85 carries pairs, 86 to 91, of push-button operated switches, each pair of switches being associated with a respective one, 93 to 98, of the electro-magnetically operated hydraulic valves 32. The valves 32 are double-acting and their operation in one direction results in a first action of an associated element, while their operation in the other direction results in a second action of the element. Thus, valve 93 is associated with piston 25 and cylinder 26, and the operation of one of the buttons 86 causes hydraulic fluid to flow in such a way that the assembly of telescopically extendable members 2, 3 and 4 is erected, while the operation of the other button 86 causes the assembly of extendable members to be lowered on to the truck 1 to the travelling position, as a result of the flow of hydraulic fluid in the opposite direction. Similarly, the buttons 87 are associated, via the valve 94, with the piston 35 and the cylinder 36 to enable the outrigger leg 15 to be raised and lowered. The buttons 88 are associated with the outrigger leg 17, via the valve 95, for the purpose of raising and lowering the outrigger leg 17.

In order to extend or retract the extendable members 2, 3 and 4, the piston 45 is caused to move out from or in to the cylinder 46 as a result of the action of hydraulic fluid passed by the valve 96 in accordance with its operation in one direction or the other under the control of one or other of the push buttons 89.

The direction of rotation of the hydraulically operated motor 65, which is employed to rotate the casing 5 is determined by which one of the buttons 90 is pressed and thus in which direction the associated valve 97 is caused to be moved.

Finally, pivotal movement of the arm 6 in a required direction is produced in accordance with the operation of the piston 10 and the cylinder 11 arrangement under the control of the valve 98 and according to the operation of a respective one of the buttons 91.

Control of the apparatus from the cage 7 is achieved by the operation of pairs 101, 102 and 103 of push buttons arranged on a control panel 104 mounted on the cage 7. A push-button 105 on the panel 104 is provided to restart the motor 30, should this be necessary. The operation of a respective one of the buttons 101 causes the members 2, 3 and 4 to be either extended or retracted as a result of the action of the valve 96, as previously described.

Similarly, the operation of a respective one of the pairs of buttons 102 and 103 controls respectively the direction of rotation of the motor 65 and thus the direction of rotation of the casing 5, and as a result of the action of the valve 97, and the direction of rotation of the arm 6, as a result of the action of the valve 98. The signals from the panel 104 are carried via cable 83, the rotatable slip ring 80, the brush assembly 81 and the cable 60 to the control panel 85. It is thus possible to control certain operations of the apparatus from either of the control panels 85 or 104. Power at 12 volts is supplied to the circuit from a terminal 106, via a d.c. power pack 107 where necessary, and a two position switch 108 which, in one position activates the panel 104 and in the other position activates the panel 85 to enable control to be provided either from the cage 7 or from the truck 1.

It will be appreciated that variations and modifications can be made within the scope of the invention to the particular embodiment shown. For example, other shapes of cross-section might be used for the members of the telescopically extendable assembly. The rectangular cross-sections shown have the advantage that they provide excellent resistance to rotational torque.

It would also be possible to fit a damper arrangement on the piston 45 and cylinder 46 arrangement so that, during retraction of the members of the telescopically extendable assembly, the final part of the retraction is carried out at a relatively slow speed.

Furthermore, it would alternatively be possible to provide an effective 360° reciprocating rotational movement of the cage 7 about the vertically extending telescopic assembly by means of a reciprocating rack and pinion assembly in place of the worm 64 and pinion wheel 66 drive, although, of course, such an arrangement would not be continuously rotatable.

In the embodiment described, the hydraulic fluid is pumped by an electrically driven motor 30. It is, of course, possible to drive the hydraulic fluid pump by some other means, for example by a take-off from the motive unit for the truck.

The motor 65 which is used for rotating the outer casing 5 is hydraulically operated. It would be possible to provide the drive by other means, for example by an electrically operated motor, although the use of such a motor might entail the need for bulky reduction gearing.

The telescopically extending assembly of members 2, 3 and 4 is operated by a hydraulically actuated piston and cylinder arrangement both to extend and to retract the assembly. However, other means, for example a cable driven system, could be used.

In the embodiment described the valves 32 are electrically controlled via a 12 volt, low voltage, circuit, and electrically operated indicators are provided to indicate the condition of operation. It would, of course, be possible to employ hydraulically controlled, as well as operated, valves.

The cage 7 is made of fibre glass, in order to render it more safe electrically and hydraulic check valves are provided in the hydraulic circuit as a safety feature to prevent the telescopic assembly from collapsing suddenly.

We claim:

1. Lifting apparatus including a telescopically extending arm, a plurality of tubular members constituting the arm, a base, means to pivot the arm about the base, a plurality of telescopically extendable outrigger legs arranged to provide support to the apparatus and a second arm, means for rotatably attaching the second arm to the one of the tubular members remote from the base, a motor, the motor being coupled to the second arm in such a way that the second arm is rotatable continuously through 360° about the longitudinal axis of the said one of the tubular members and means for rotatably attaching the said second arm to the said one of the tubular members for rotation in a plane containing the said axis, wherein means for supplying power for the motor and for rotating the second arm in the plane containing the axis are arranged within the tubular members constituting the first mentioned arm.

2. Apparatus as claimed in claim 1 including means for pivotally attaching the outrigger legs to a second one of the tubular members, the second one of the members being the one directly attached pivotally to the base.

3. Apparatus as claimed in claim 1 including a plate constituting the base, whereby the base can be attached to a vehicle, the vehicle also providing support for the apparatus.

4. Apparatus as claimed in claim 2 including a platform attached to the second arm at a point remote from the said one of the tubular members.

5. Apparatus as claimed in claim 1 including a pinion wheel attached to the first mentioned one of the tubular members and fixed relative thereto, a worm attached to the second arm and a motor arranged to rotate the worm, the worm and pinion co-operating to cause rotation of the second arm about the longitudinal axis of the first-mentioned arm in accordance with the rotation of the motor.

6. Apparatus as claimed in claim 1 including a source of hydraulic fluid, a plurality of piston and cylinders coupled to the said source, a plurality of electromagnetically operated valves arranged to control the flow of hydraulic fluid to respective ones of the cylinders and a plurality of push-buttons connected electrically to respective valves to control the operation of the valves, respective ones of the pistons and cylinders controlling the extension of the telescopic arm, the pivoting of the arm about the base, the extension of the outrigger legs and the rotation of the second arm in the plane containing the said axis.

* * * * *